US012492529B2

(12) United States Patent
Mayer et al.

(10) Patent No.: US 12,492,529 B2
(45) Date of Patent: Dec. 9, 2025

(54) BOOM ASSEMBLY FOR AN EXCAVATION VEHICLE AND METHOD THEREOF

(71) Applicant: Federal Signal Corporation, Oak Brook, IL (US)

(72) Inventors: Timothy G. Mayer, Metamora, IL (US); Joseph L. Schmidt, Tonica, IL (US)

(73) Assignee: Federal Signal Corporation, Downers Grove, IL (US)

( * ) Notice: Subject to any disclaimer, the term of this patent is extended or adjusted under 35 U.S.C. 154(b) by 858 days.

(21) Appl. No.: 17/412,897

(22) Filed: Aug. 26, 2021

(65) Prior Publication Data

US 2022/0145583 A1 May 12, 2022

Related U.S. Application Data

(60) Provisional application No. 63/111,934, filed on Nov. 10, 2020.

(51) Int. Cl.
*E02F 3/90* (2006.01)
*E02F 3/88* (2006.01)

(52) U.S. Cl.
CPC ..... *E02F 3/905* (2013.01); *E02F 3/8825* (2013.01); *E02F 3/90* (2013.01)

(58) Field of Classification Search
CPC . E02F 3/8816; E02F 3/90; E02F 3/905; E02F 3/8825; E02F 3/8841; E02F 3/88
See application file for complete search history.

(56) References Cited

U.S. PATENT DOCUMENTS 4,659,262 A 4/1987 Van Aalst
4,669,145 A 6/1987 Kehr
(Continued)

FOREIGN PATENT DOCUMENTS

CN 110512678 A * 11/2019 ..... E02F 3/88
CN 110512678 B * 9/2023 ..... E02F 3/88
(Continued)

OTHER PUBLICATIONS

International Search Report and Written Opinion for Application No. PCT/US2019/016060 dated Sep. 4, 2019, 22 pages.
(Continued)

*Primary Examiner* — Christopher J Sebesta
*Assistant Examiner* — Blake E Scoville
(74) *Attorney, Agent, or Firm* — Merchant & Gould P.C.

(57) ABSTRACT

A boom assembly for an excavation vehicle includes a bracket configured to couple to a turret that is rotatably mounted to a debris body. Three or more telescoping support members. A first support member of the three or more telescoping support members is pivotably coupled to the bracket, a second support member of the three or more telescoping support members supports a shoe at a distal end, and a third support member of the three or more telescoping support members is disposed at least partially between the first support member and the second support member. The boom assembly also includes a single actuator. One end of the actuator is coupled to the first support member and the other end of the actuator is coupled to the second support member. The actuator is configured to extend and retract the second support member relative to the first support member.

25 Claims, 13 Drawing Sheets

(56) References Cited

U.S. PATENT DOCUMENTS

| | | | | |
|---|---|---|---|---|
| 4,922,571 | A | 5/1990 | Driear | |
| 4,935,984 | A | 6/1990 | Bryant et al. | |
| 5,050,265 | A | 9/1991 | Stout et al. | |
| 5,408,766 | A * | 4/1995 | Pobihushchy | E02F 3/907 37/905 |
| 5,577,772 | A * | 11/1996 | Kaiser | E03F 7/106 15/302 |
| 6,438,792 | B1 | 8/2002 | Cappellotto | |
| 6,792,646 | B1 * | 9/2004 | Greene | A47L 9/0036 15/340.1 |
| 7,658,351 | B2 | 2/2010 | Hansen | |
| 7,712,481 | B1 * | 5/2010 | Mayer | E03F 7/106 137/355.24 |
| 8,505,858 | B2 | 8/2013 | Hansen | |
| 8,881,341 | B2 | 11/2014 | Schmidt, Jr. | |
| 10,759,324 | B2 * | 9/2020 | Malmassari | B60P 1/60 |
| D916,143 | S | 4/2021 | Malmassari et al. | |
| D934,923 | S | 11/2021 | Malmassari et al. | |
| 11,878,620 | B2 * | 1/2024 | Malmassari | A47L 9/244 |
| 2002/0020760 | A1 * | 2/2002 | Beggs | A01M 7/0053 239/166 |
| 2004/0069356 | A1 | 4/2004 | Lehnhardt et al. | |
| 2010/0018590 | A1 | 1/2010 | Damaske et al. | |
| 2015/0075624 | A1 | 3/2015 | Mahaffa et al. | |
| 2017/0342700 | A1 | 11/2017 | Wiedemann | |
| 2019/0255981 | A1 * | 8/2019 | Malmassari | B60P 1/60 |
| 2020/0391648 | A1 * | 12/2020 | Malmassari | A01G 20/47 |

FOREIGN PATENT DOCUMENTS

| | | | | |
|---|---|---|---|---|
| WO | 9703321 | A1 | 1/1997 | |
| WO | WO-2019160692 | A3 * | 10/2019 | A01G 20/47 |

OTHER PUBLICATIONS

Invitation to Pay Additional Fees for PCT Application No. PCT/US2019/016060, dated May 22, 2019, 14 pages.

Attachment A, Photo of Vactor Boom Design, dated prior to May 28, 2020.

Attachment B, Photo of Westech Boom Design, dated prior to May 28, 2020.

Attachment C, Photo of Boom Design on Rival Hydrovac dated prior to May 28, 2020.

* cited by examiner

BOOM ASSEMBLY FOR AN EXCAVATION VEHICLE AND METHOD THEREOF

CROSS-REFERENCE TO RELATED APPLICATION

This application claims the benefit of U.S. Provisional Patent Application Ser. No. 63/111,934, filed Nov. 10, 2020, which is incorporated herein by reference in its entirety.

BACKGROUND

Excavation vehicles are generally used for excavation processes. Non-destructive (e.g., non-evasive) excavation is the process of using a fluid (e.g., air, water, or the like) to disturb material (e.g., soil) to be excavated, which is then vacuumed up through a hose into a debris body. The material, also known as debris, typically travels through the hose and enters the debris body at or near the top of the body. In some examples, a boom assembly is disposed at the top of the debris body and structurally supports the hose. The boom assembly can be rotatable, pivotable, and/or extendable so that the hose can be supported in a variety of positions as required or desired.

SUMMARY

In general terms, the present disclosure relates to boom assemblies that support a vacuum hose for excavation vehicles. The boom assembly includes three or more telescoping support members and a single actuator. The actuator extends between the outermost support members to drive extension and retraction movement of the boom assembly. By using three or more telescoping members, the extended length of the boom assembly relative to a collapsed length is increased. Additionally, each of the support members facilitates support of the vacuum hose in any extension or retracted position of the boom assembly.

In one aspect, the technology relates to a boom assembly for an excavation vehicle including: a bracket configured to couple to a turret that is rotatably mounted to a debris body of the excavation vehicle; three or more telescoping support members, wherein a first support member of the three or more telescoping support members is pivotably coupled to the bracket, wherein a second support member of the three or more telescoping support members supports a shoe at a distal end, and wherein a third support member of the three or more telescoping support members is disposed at least partially between the first support member and the second support member; and a single actuator, wherein one end of the actuator is coupled to the first support member and the other end of the actuator is coupled to the second support member, and wherein the actuator is configured to extend and retract the second support member relative to the first support member.

In an example, an elongated track is defined within the third support member and a proximal end of the second support member is slidingly engaged with the elongated track. In another example, a length of the elongated track at least partially defines an extended length of the second support member relative to the third support member. In yet another example, a vacuum hose is supported by each of the three or more telescoping support members. In still another example, the vacuum hose is side-by-side with the three or more telescoping support members. In an example, the actuator is disposed at least partially between the vacuum hose and the three or more telescoping support members.

In another example, a distal end of the third support member includes a roller support for the vacuum hose. In yet another example, the actuator includes a single hydraulic cylinder actuator. In still another example, the three or more telescoping support members have a collapsed length of about 15 feet and an extended length of about 22 feet. In an example, the three or more telescoping support members have an extension length of greater than or equal to 7 feet. In another example, each of the three or more telescoping support members have a substantially rectangular cross-section.

In another aspect, the technology relates to an excavation vehicle including: a debris body; a vacuum hose; a turret rotatably coupled to a top of the debris body and coupling the debris body and the vacuum hose in flow communication; and a boom assembly coupled to the turret and configured to at least partially support the vacuum hose, wherein the boom assembly includes: a shoe configured to support at least a portion of the vacuum hose; a bracket that mounts to the turret; a first support member pivotably coupled to the bracket; a second support member slidingly supported at least partially within the first support member; a third support member slidingly supported at least partially within the second support member, wherein the shoe is coupled to the third support member; and a hydraulic cylinder configured to extend and retract the shoe relative to the turret, wherein the hydraulic cylinder is supported on the first and third support members.

In an example, the second support member has a first end and a second end, and the third support member has a first end and a second end, the second end of the third support member extends out from the second end of the second support member, and an elongated track is defined proximate the first end of the second support member and a pin is coupled to the third support member proximate the first end, the pin being slidably received at least partially within the elongated track. In another example, the elongated track at least partially defines relative movement between the third support member and the second support member. In yet another example, the boom assembly is configured to move between an extended configuration and a retracted configuration, and in both the extended configuration and the retracted configuration, the elongated track of the second support member is disposed within the first support member. In still another example, the first end of the third support member is disposed within the first support member in the extended configuration of the boom assembly. In an example, the second end of the second support member includes a roller support for the vacuum hose.

In another example, the hydraulic cylinder is a single stage hydraulic cylinder, and the hydraulic cylinder is disposed at least partially between the support members and the vacuum hose. In yet another example, a second hydraulic cylinder is coupled between the first support member and the bracket, the second hydraulic cylinder is configured to raise and lower the shoe relative to the turret. In still another example, the vacuum hose is side-by-side with the boom assembly on top of the debris body. In an example, the vacuum hose includes at least one substantially rigid section and at least one substantially flexible section.

In another aspect, the technology relates to a method of supporting a vacuum hose on a boom assembly, the method including: mounting the vacuum hose side-by-side with three or more telescoping support members of the boom assembly, wherein the three or more telescoping support members define a longitudinal axis of the boom assembly and at least a portion of the vacuum hose is disposed substantially parallel to the longitudinal axis; extending the boom assembly along the longitudinal axis, wherein an actuator is coupled between outermost and innermost members of the three or more telescoping support members, wherein extending movement of the innermost member relative to the outermost member drives movement of one or more middle members of the three or more telescoping support members, and wherein each of the three or more telescoping support members support the vacuum hose.

In an example, the method further includes retracting the boom assembly along the longitudinal axis, wherein retracting movement of the innermost member relative to the outermost member drives movement of the inside member. In another example, the inside member includes a roller support and the step of extending the boom assembly includes rolling the one or more middle members relative to the vacuum hose. In yet another example, the method further includes pivoting the boom assembly, wherein the vacuum hose raises or lowers with the boom assembly and maintains the side-by-side orientation during pivoting. In still another example, the method further includes rotating the boom assembly, wherein the vacuum hose maintains the side-by side orientation during rotation.

DETAILED DESCRIPTION

Figure 1:
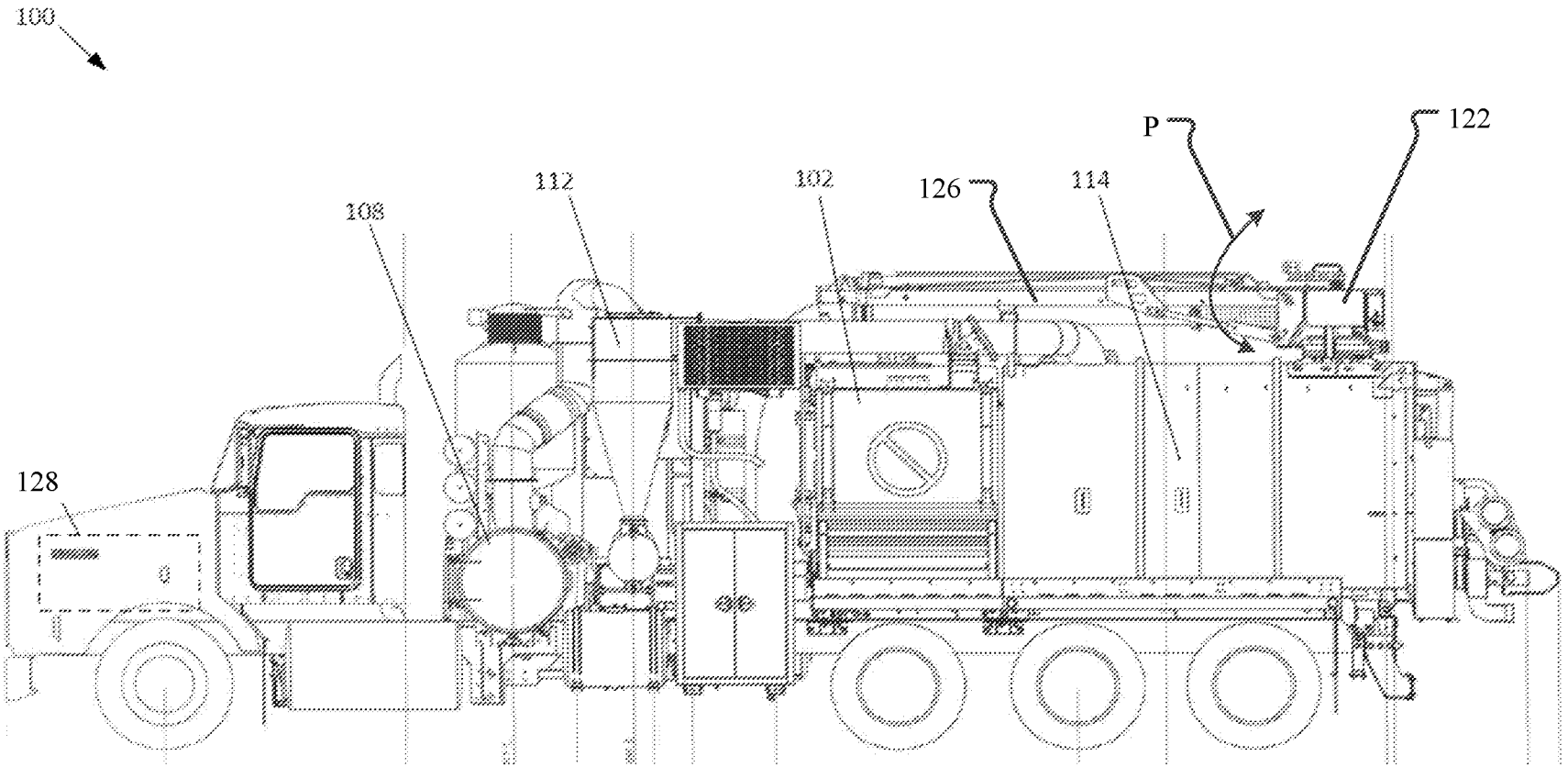
FIG. 1 is a side elevation view of an exemplary excavation vehicle.

Various embodiments will be described in detail with reference to the drawings, wherein like reference numerals represent like parts and assemblies throughout the several views.

This disclosure describes a boom assembly for excavation vehicles that is configured to support a vacuum hose in a variety of positions. The boom assembly is disposed on top of a debris body of the excavation vehicle and provides a cantilevered support structure for the vacuum hose. The boom assembly can rotate relative to the debris body and pivot to raise or lower the hose relative to the debris body. Additionally, the boom assembly can extend and retract to extend the reach of the vacuum hose. The boom assembly includes three or more telescoping support members and a single actuator. The actuator extends between the outermost support members to drive the extension and retraction movement of the boom assembly. By using three or more telescoping members, the extended length of the boom assembly relative to a collapsed length is increased. This configuration allows for a greater extension reach of the vacuum hose while still being collapsible and stored on top of the excavation vehicle. Additionally, each of the support members facilitates support of the vacuum hose. This hose support reduces or prevents sagging and low spots in the hose during use that tend to collect excavated debris and undesirable plugging of the hose.

Figure 2:
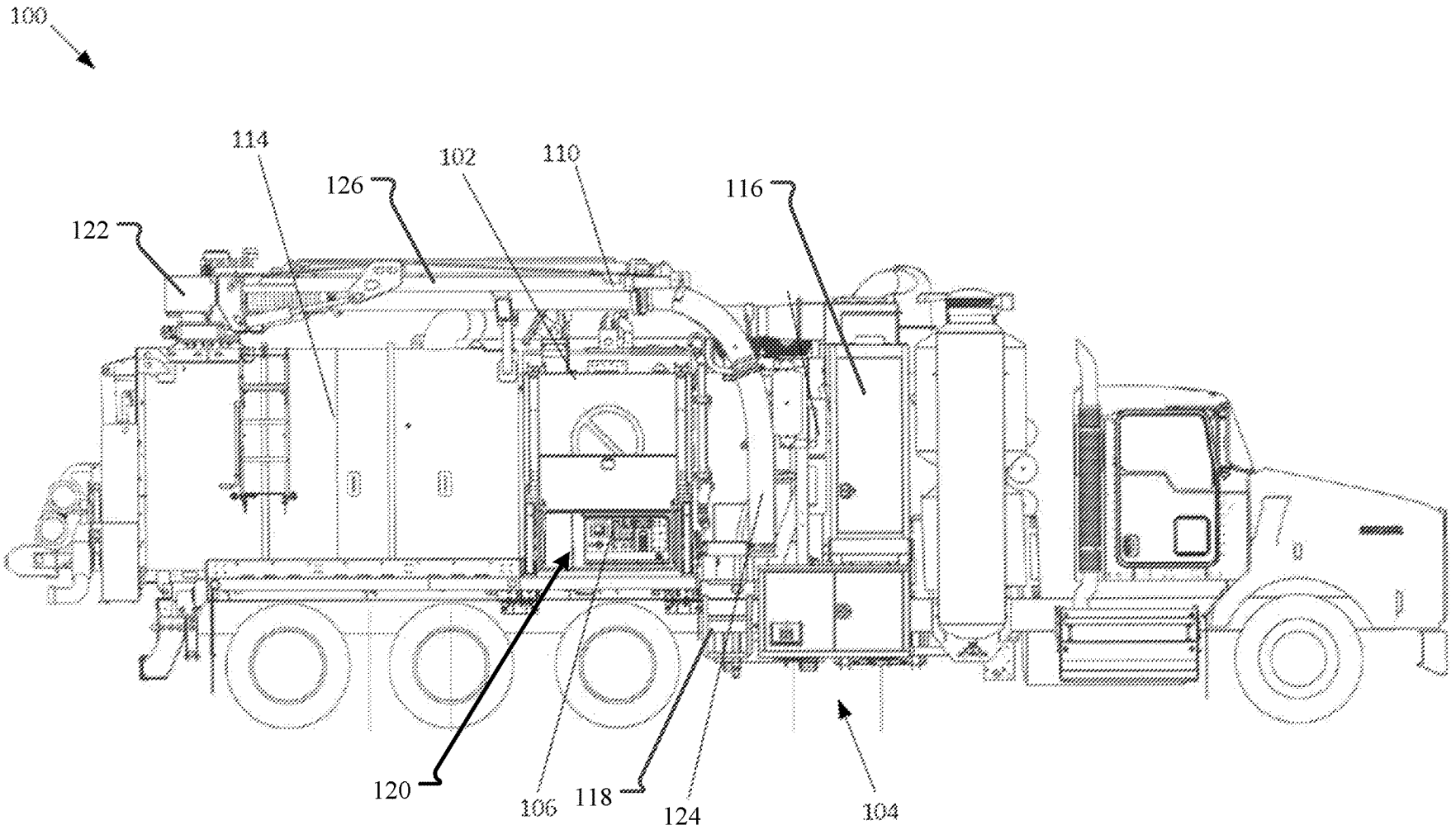
FIG. 2 is another side elevation view of the excavation vehicle shown in FIG. 1.
Figure 3:
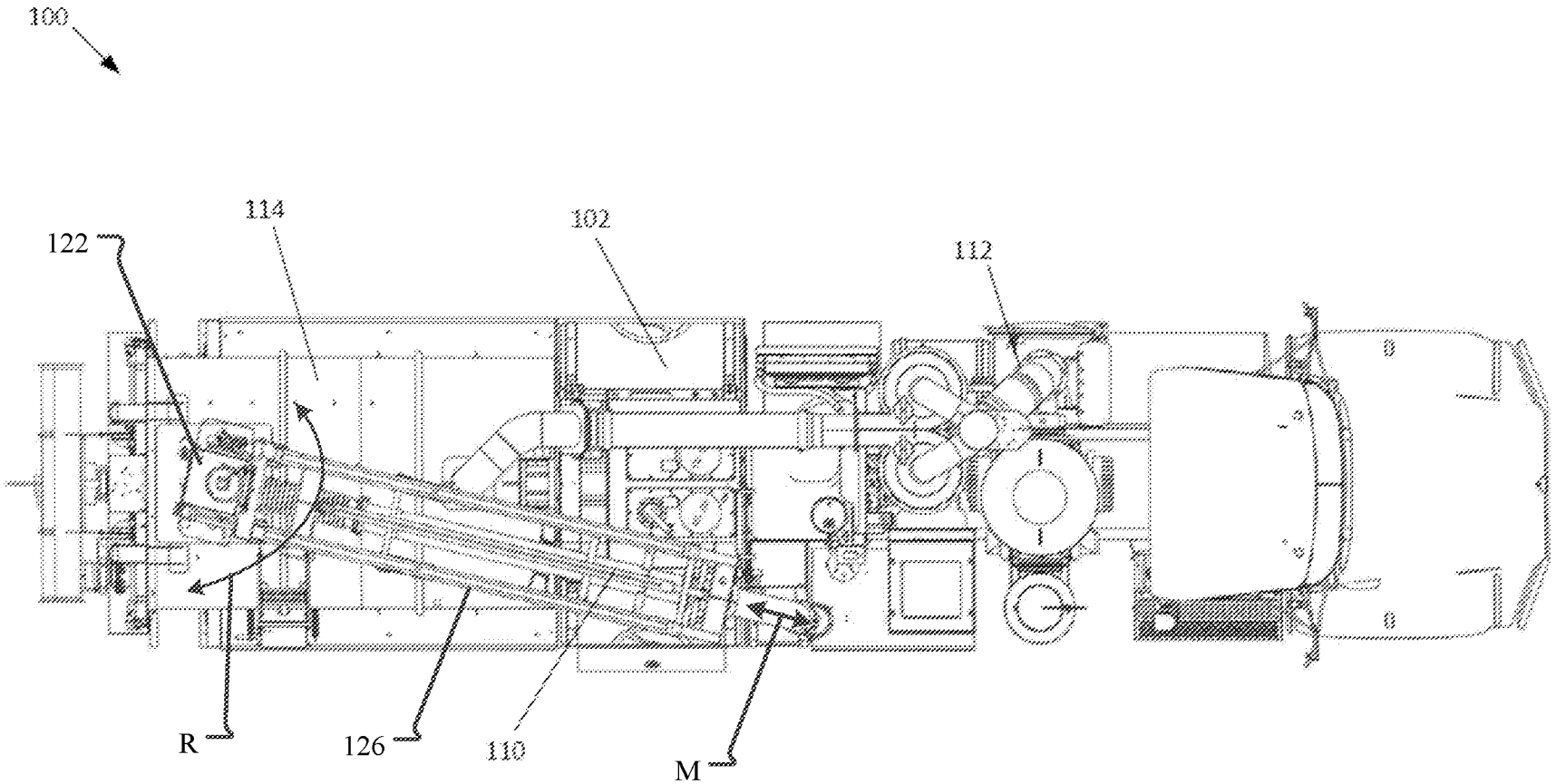
FIG. 3 is a top view of the excavation vehicle shown in FIG. 1.

FIG. 1 is a side elevation view of an exemplary excavation vehicle 100. FIG. 2 is another side elevation view of the excavation vehicle 100. FIG. 3 is a top view of the excavation vehicle 100. Referring concurrently to FIGS. 1-3, the vehicle 100 can include a water tank 102, a water pump control system 104, a control panel 106, an air mover 108, a boom and vacuum hose 110, a cyclone separator 112, a debris body 114, a water heating system 116, an air compressor 118, and an air compressor control system 120. In the example, the vehicle 100 is described as a combination hydro/air excavation unit meaning that it can use either water to cut the excavated material or air. In other aspects, the vehicle 100 may be a hydro-only excavation unit that uses only water or an air-only excavation unit that uses only air as required or desired.

The vehicle 100 includes a water pump system to generate pressurized water for injecting to the material (e.g., soil) and breaking it up while removing debris by air suction and the hose 110. The water tank 102 operates to contain the water used for hydro excavation, while the water pump control system 104 can be used to control flow rate, pressure, etc. The vehicle 100 also includes an air compression system to generate compressed air for injecting to the soil and breaking it up while removing debris by air suction and the hose 110. The air compressor 118 operates to generate pressurized air, while the air compressor control system 120 can be used to control flow rate, pressure, etc.

The control panel 106 is configured to enable an operator to interact with several operative elements of the vehicle 100, such as the water pump control system 104 and/or the air compressor control system 120. In the example, the control panel 106 is contained in a control box that is located curbside of the vehicle 100 for easy access and efficient operation. The control panel 106 can provide various controls, such as a tachometer and hour meter for various components (e.g., a water pump and a fan), temperature indicators for various systems, a water pump circuit on/off switch, boom and body dump functions, an emergency stop button, compressed air circuit solenoid release valves, and various other controls. The control panel 106 can communicate with a remote controller that is operated by the operator with either wireless or wired connection. In some embodiments, the control panel 106 includes a display screen to display various pieces of information, such as water or air pressure.

The air mover 108 operates to actuate a mover to create a vacuum through the hose 110 to draw debris into the debris body 114. The hose 110 is rotatably mounted on the top of the debris body 114 and rotatable R at least partially around the vehicle 100. The hose 110 is also extendable to cover a large working area. In the example, the hose 110 is mounted to the debris body 114 via a turret 122. The turret 122 couples the debris body 114 and the hose 110 in fluid communication. The turret 122 can rotate R relative to the debris body 114 to enable hose 110 movement. In an example, the rotation R can be a full 360° or be limited to a smaller rotational angle (e.g., about 320°). The hose 110 can include a replaceable tube 124 at a forward end thereof for digging and excavation. In an aspect, the hose 110 can be about 6 inches in diameter, although other sizes are also contemplated herein.

In the example, the hose 110 is at least partially supported by a boom assembly 126. The boom assembly 126 cantilevers from the turret 122 so that it is rotatable R relative to the debris body 114. Additionally, the boom assembly 126 is configured to extend and retract M relative to the turret 122 so that the hose 110 can cover a large working area. Furthermore, the boom assembly 126 is configured to pivot P relative to the turret 122 so that the hose 110 can be raised and lowered with relative to the debris body 114. The boom assembly 126 is described further below in reference to FIGS. 4-8.

The cyclone separator 112 operates with the air mover 108 to filter air, thereby increasing air-routing performance. The debris body 114 is configured to collect debris through the hose after the soil is cut and broken down by the pressurized fluid (e.g., air or water). As used herein, debris, can include dirt, soil, sand, gravel, clay, aggregate, rocks, bricks, or any other type of material that is required or desired to be excavated and either wet or dry. The water heating system 116 operates to preheat water in the water tank 102 in cold weather conditions. The vehicle 100 also includes an engine 128 for driving and/or operating the systems and components described herein. In other examples, an auxiliary power plant or engine may be provided as required or desired. Additionally, the vehicle 100 can include one or more hydraulic systems to enable movement of one or more of the components (e.g., the boom and vacuum hose 110) as described herein. The hydraulic systems can be in communication with the control panel 106 for operational movement.

Figure 4:
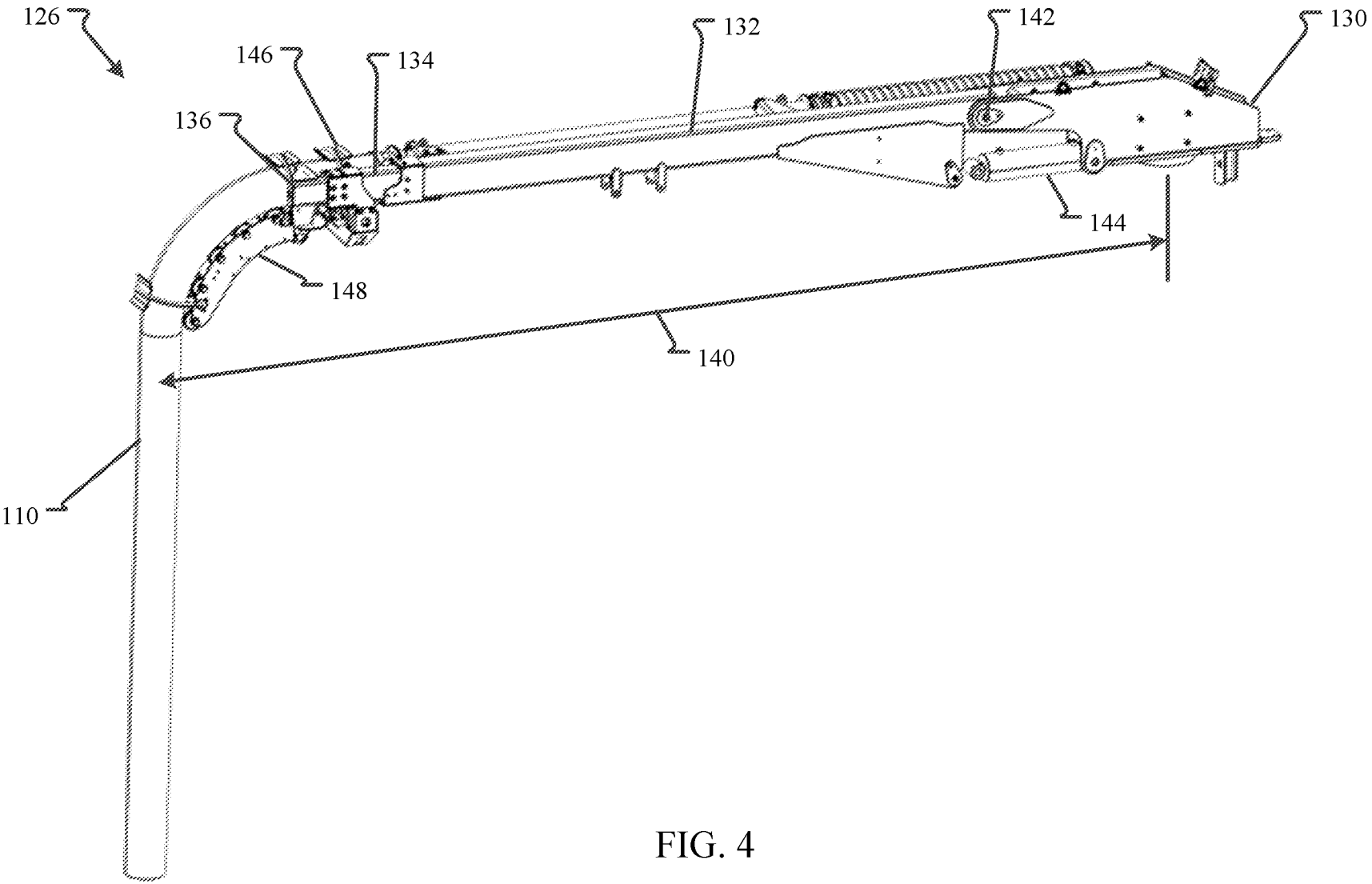
FIG. 4 is a perspective view of an exemplary boom assembly for the excavation vehicle shown in FIG. 1 and in a retracted configuration.
Figure 5:
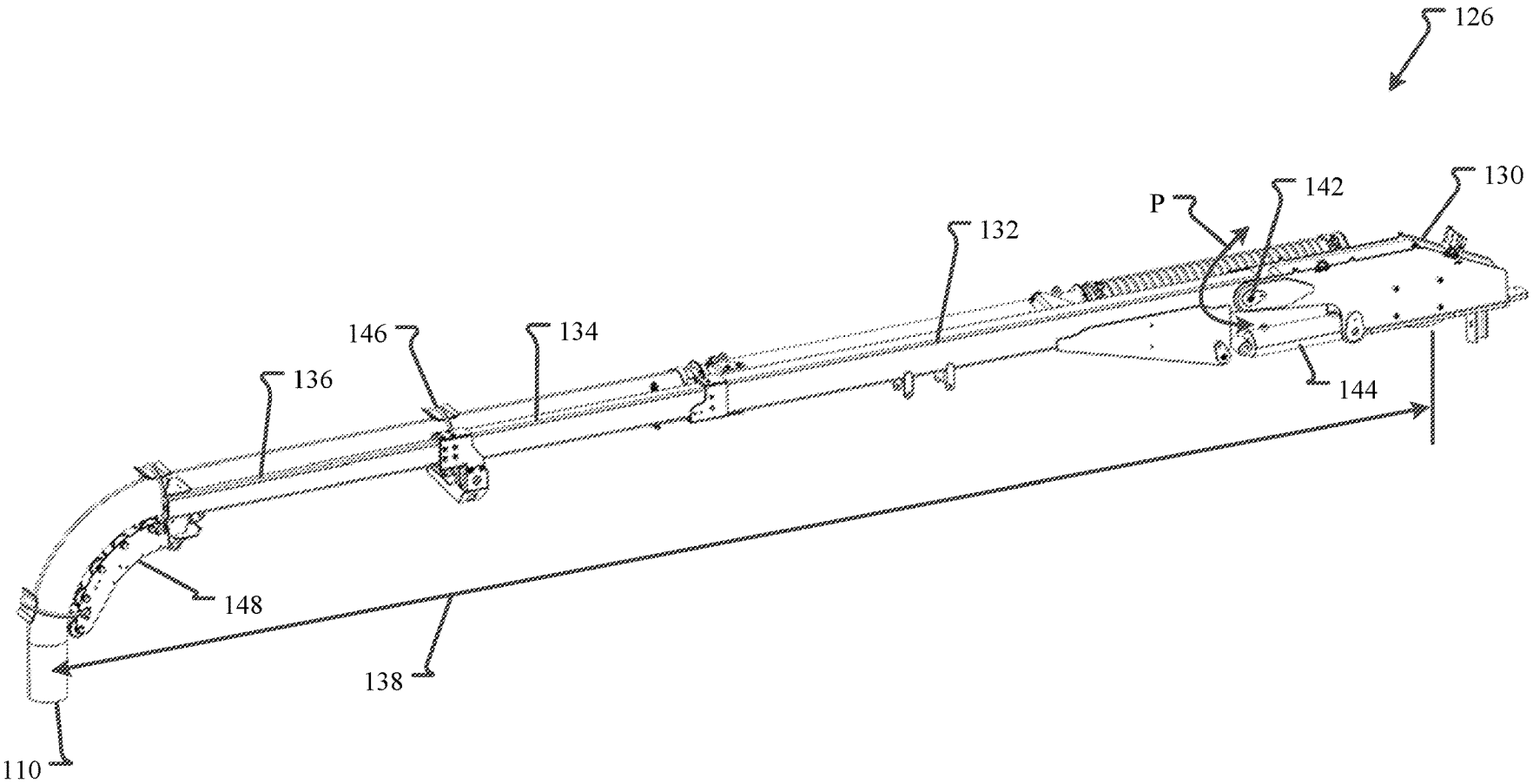
FIG. 5 is a perspective view of the boom assembly in an extended configuration.

FIG. 4 is a perspective view of the boom assembly 126 for the excavation vehicle 100 (shown in FIGS. 1-3) and in a retracted configuration. FIG. 5 is a perspective view of the boom assembly 126 in an extended configuration. Referring concurrently to FIGS. 4 and 5, the boom assembly 126 is configured to at least partially support the vacuum hose 110 in a cantilevered system. The boom assembly 126 includes a bracket 130 configured to couple to the turret 122 (shown in FIGS. 1-3). The bracket 130 enables the boom assembly 126 to rotate relative to the debris body 114 (shown in FIGS. 1-3) with the turret 122. Three or more telescoping support members 132, 134, 136 are cantilevered from the bracket 130. The telescoping support members 132, 134, 136 are configured to extend as illustrated in FIG. 5 and define an extended length 138 from the centerline of the turret 122 to the centerline of the hose 110 at the end of a shoe 148. This configuration facilitates positioning and supporting the hose 110 at extended distances from the excavation vehicle as required or desired. Additionally, the telescoping support members 132, 134, 136 are configured to retract as illustrated in FIG. 4 and define a collapsed length 140 from the centerline of the turret 122 to the centerline of the hose 110 at the end of the shoe 148. This configuration facilitates positioning and supporting the hose 110 at close distances from the excavation vehicle and for transportation.

In an aspect, the extended length 138 is about 22 feet and the collapsed length 140 is about 15 feet. As such, an extension length of the telescoping support members 132, 134, 136 is greater than or equal to 7 feet. By using three or more telescoping support members 132, 134, 136 the extended length 138 can be longer for the same collapsed length 140 when compared to using two telescoping support members. As such, the storage area on the excavation vehicle for the boom assembly 126 can remain constant, while the boom assembly 126 enables a longer extension length.

In the example, the first support member 132 is pivotably coupled to the bracket 130 at a pivot point 142. A hydraulic cylinder actuator 144 extends between the bracket 130 and the first support member 132 and is configured to drive pivoting movement P of the boom assembly 126. This pivoting movement P allows the hose 110 to be raised and lowered relative to the debris body 114 as required or desired. The second support member 134 is slidably engaged with the first support member 132 and is configured to extend and retract relative to a distal end of the first support member 132. A hose support 146 is coupled to the second support member 134 and is used to support the hose 110. The third support member 136 is slidably engaged with the second support member 134 and is configured to extend and retract relative to a distal end of the second support member 134. A shoe 148 is coupled to the third support member 136 and is also used to support the hose 110.

In operation, the excavation vehicle generates a vacuum and debris is channeled through the vacuum hose 110. The boom assembly 126 is coupled to the vehicle's hydraulic system and can be used to raise or lower the hose 110 relative to the debris body by pivoting about the pivot point 142 via the actuator 144. Additionally, the hose 110 can be extended or retracted relative to the debris body by moving the third support member 136 via the actuator 152 (shown in FIGS. 6 and 7). Additionally, each of the support members 132, 134, 136 all provide support to the vacuum hose 110 to reduce hose sagging and debris accumulation and clogging.

Figure 6:
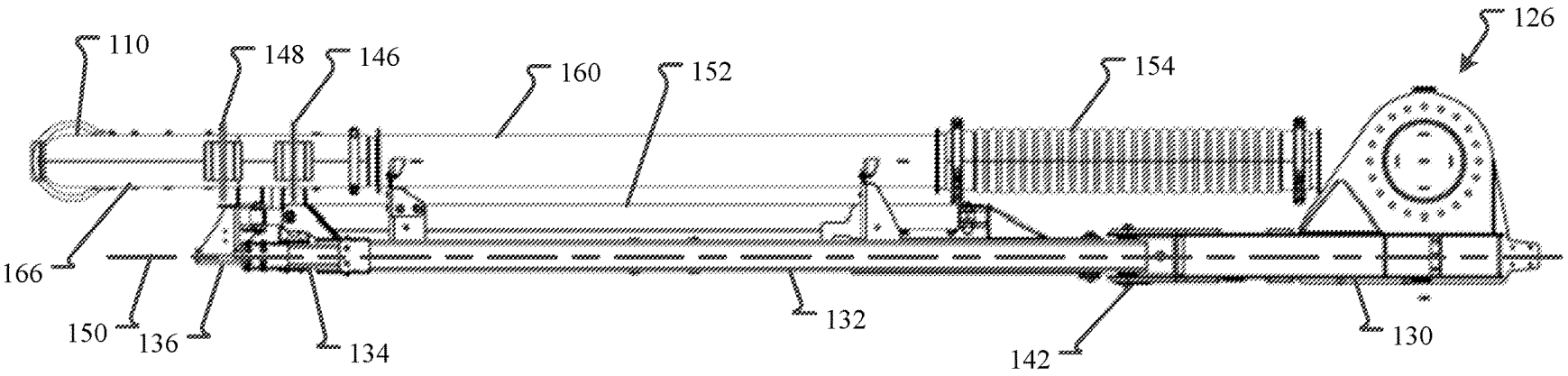
FIG. 6 is a top view of the boom assembly.
Figure 7:
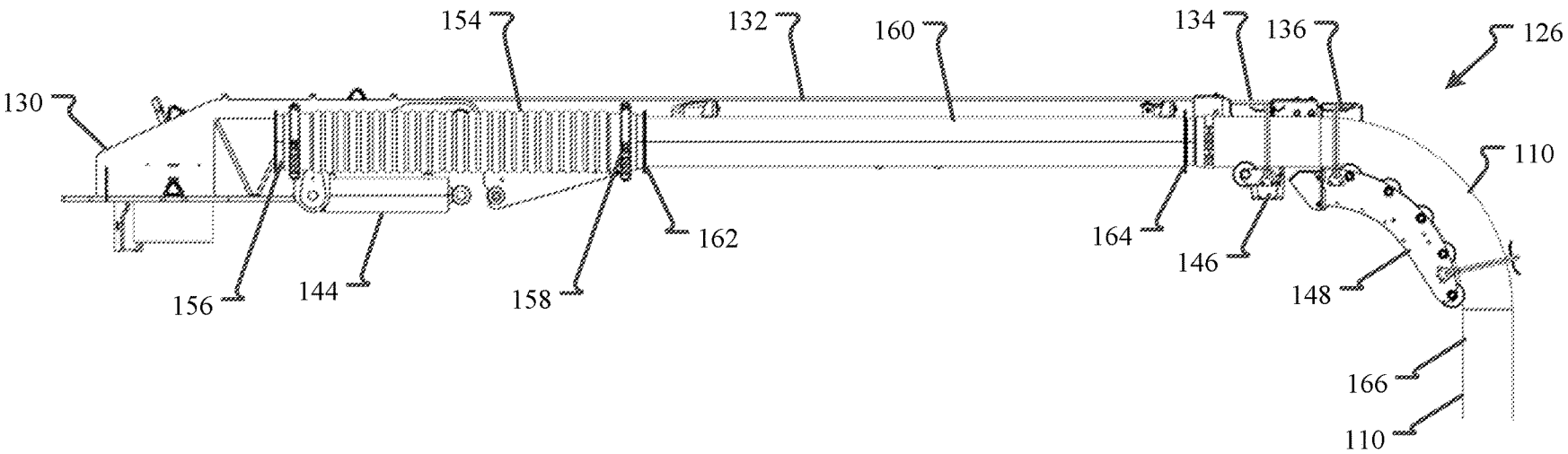
FIG. 7 is an elevation view of the boom assembly.

FIG. 6 is a top view of the boom assembly 126. FIG. 7 is an elevation view of the boom assembly 126. Referring concurrently to FIGS. 6 and 7, the telescoping support members 132, 134, 136 define a longitudinal axis 150 that the members extend and retract along. The boom assembly 126 has a single hydraulic cylinder actuator 152 that drives the extension and retraction movement of the boom assembly 126. The actuator 152 is coupled to and extends between the first support member 132 and the third support member 136 substantially parallel to the longitudinal axis 150. In the example, the second support member 134 is not directly coupled to the actuator 152. As such, the actuator 152 driving extension and retraction movement of the third support member 136 relative to the first support member 132 and indirectly drives movement of the second support member 134.

The vacuum hose 110 is disposed side-by-side with the support members 132, 134, 136 and substantially parallel to the longitudinal axis 150. In an aspect, the actuator 152 is disposed at least partially between the hose 110 and the support members 132, 134, 136. In another aspect, the hose 110 is disposed below the top of the support members 132, 134, 136. By supporting the hose 110 on the side of the support members 132, 134, 136, the overall height of the boom assembly 126 and the excavation vehicle is reduced. In other examples, the hose 110 may be disposed and supported on top of the support members 132, 134, 136 as required or desired. In still other examples, the hose 110 may be disposed between a pair of telescoping support members as shown in FIGS. 1-3.

The hose 110 is supported by each of the support members 132, 134, 136. These hose support locations reduce or prevent low spots in the hose 110 when the hose is extended and maintains the hose 110 in a substantially parallel orientation with respect to the support members 132, 134, 136. Low spots in the hose 110 can allow excavated material to collect during the excavation process. Once excavated material begins to collect in the low sport, the material continues to build up while increasing the sag of the hose 110 and ultimately plugging the hose 110.

In the example, the hose 110 is at least partially flexible, for example, it can bend around the shoe 148 and sag if not supported. However, the hose 110 does not extend or retract itself. Rather, the hose supports (e.g., the shoe 148 and the support 146) support the vacuum hose 110 on rollers. In an aspect, the free end of the hose 110 is configured to receive attachments (e.g., the tube 124 shown in FIG. 2) so that the hose 110 can maintain its reach to the ground surface even when the boom assembly 126 in in an extended position.

As shown in FIGS. 5 and 6, the hose 110 may include a plurality of discrete sections coupled together. By using a plurality of sections, high wear portions of the hose 110 are more easily maintained and replaceable. Additionally, different sections can have different diameters as required or desired, and different sections are more easily coupled to the support members 132, 134, 136. A first hose section 154 is configured to couple to the turret 122 (shown in FIGS. 1-3, but not in FIGS. 6 and 7) at one end 156 and be supported at the other end 158 on the first support member 132. The first hose section 154 extends past the pivot point 142 and is flexible so that the first support member 132 can pivot about the pivot point 142 on the bracket 130. A second hose section 160 is coupled to the first support member 132 at both ends 162, 164 such that it is fixed to the first support member 132. In an aspect, the second hose section 160 may be substantially rigid to reduce sagging and low points and because it does not need to bend. A third hose section 166 is coupled to the end 164 of the second hose section 160 and is supported by the hose support 146 on the second support member 134 and the shoe 148 on the third support member 136. Both the hose support 146 and the shoe 148 are roller-type supports so that the boom assembly 126 can extend and retract as required or desired. It should be appreciated that the hose 110 can have any other configuration as required or desired. For example, a greater number or a fewer number of sections and/or different variations of flexible or rigid sections.

Figure 8:
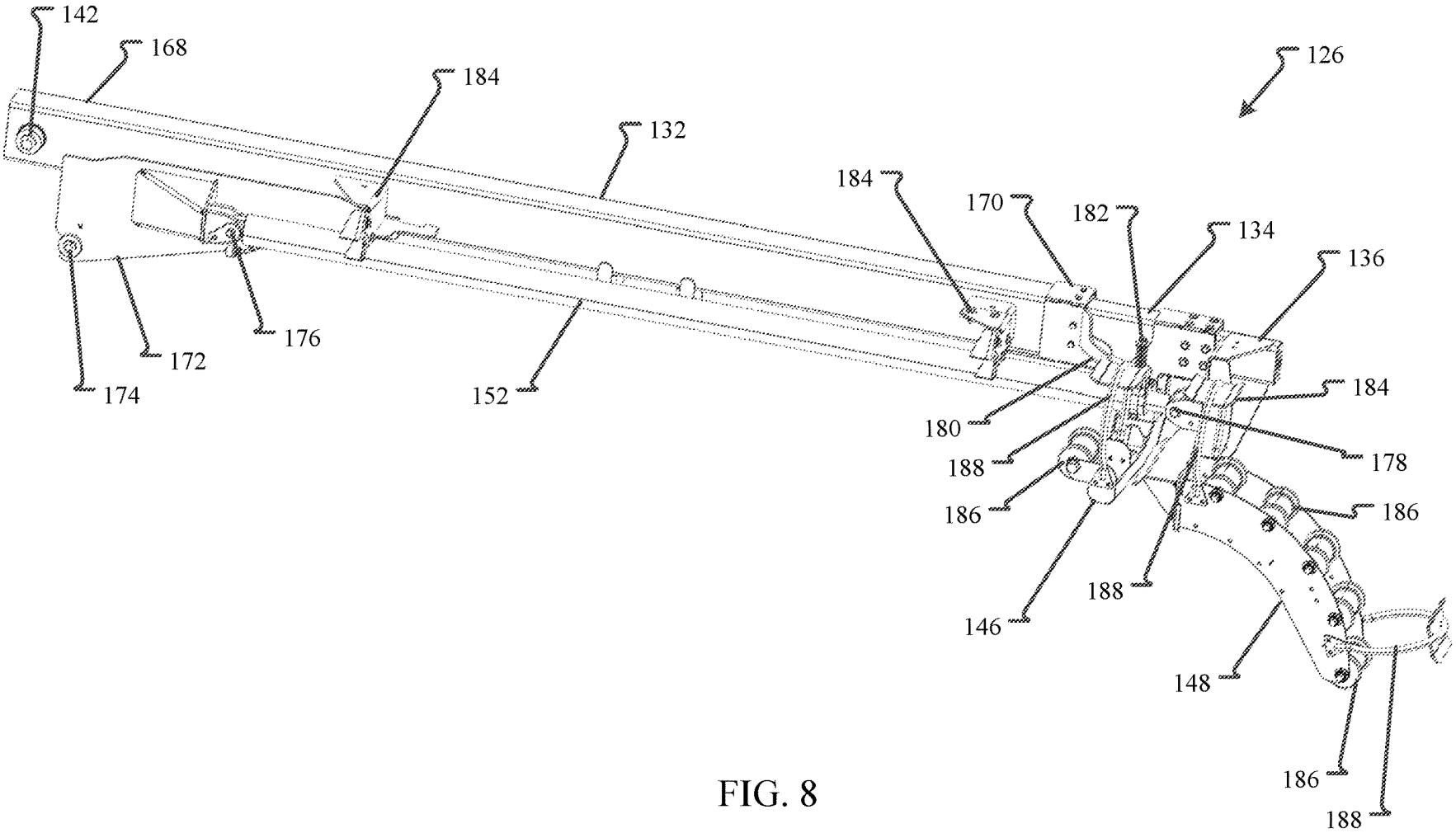
FIG. 8 is a perspective view of a portion of the boom assembly.

FIG. 8 is a perspective view of a portion of the boom assembly 126. The first support member 132 has a first end 168 that is pivotably coupled to the bracket 130 (shown in FIGS. 6 and 7) at the pivot point 142 and an opposite section end 170. Proximate the first end 168 one or more mounting plates 172 are coupled to the side of the support member 132 and extend in a downward direction. The mounting plate 172 includes an attachment point 174 for the actuator 144 (shown in FIG. 7) that drives pivoting movement about the pivot point 142. The attachment point 174 is below and forward of the pivot point 142 to facilitate the pivoting movement of the support member 132. Additionally, the mounting plate 172 supports one end 176 of the actuator 152. The other end 178 of the actuator 152 is coupled to a distal end of the third support member 136 and proximate the shoe 148. In the example, the actuator 152 is a single cylinder hydraulic actuator. By using only a single cylinder actuator the extension and retraction movement of the third support member 136 is more easily achieved when compared to using multiple actuators (e.g., one for each support member). It should be appreciated, that the actuator 152 may be any other type of actuator that enables the function of the boom assembly 126 as described herein. In an aspect, the actuator 152 includes a barrel that is supported on the first support member 132 and a moveable rod that extends and retracts therefrom that is coupled on the third support member 132. The second end 170 of the first support member 132 includes a support arm 180 that is configured to support one end of the barrel of the actuator 152 opposite of end 176 and the actuator 152 is supported proximate both the first and second ends 168, 170 of the first support member 132. The support arm 180 can include a spring dampener 182 as required or desired. The first support member 132 also includes a pair of mounting brackets 184 proximate the first and second ends 168, 170 that are configured to couple to at least a portion of the vacuum hose 110 (e.g., the second hose section 160 shown in FIGS. 6 and 7).

The shoe 148 is coupled to a distal end of the third support member 136. The shoe 148 includes a plurality of rollers 186 that are positioned in a curved array. This position of the rollers 186 define the bend radius of the vacuum hose. The shoe 148 forms a distal support on the boom assembly 126 for the hose and the rollers 186 enable axial movement of the hose while the boom assembly 126 extends and retracts. The shoe 148 also includes one or more hoops 188 that are configured to hold down the hose on the shoe 148.

The second support member 134 is disposed at least partially between the first and third support members 132, 136. A distal end of the second support member 134 includes the hose support 146. The hose support 146 also has one or more rollers 186 and a hoop 188 for supporting the vacuum hose. The hose support 146 is configured as an intermediate support for the hose between the shoe 148 and the mounting bracket 184 and to reduce or prevent material accumulation due to hose low points. The hose support 146 also moves with the second support member 134 such that it provides hose support at any extension or retraction distance. In the example, the second support member 134 is slidingly supported at least partially within the first support member 132 and the third support member 136 is slidingly supported at least partially within the second support member 134. As such, all three support members 132, 134, 136 are telescoping and can extent and retract via the actuator 152.

Figure 9:
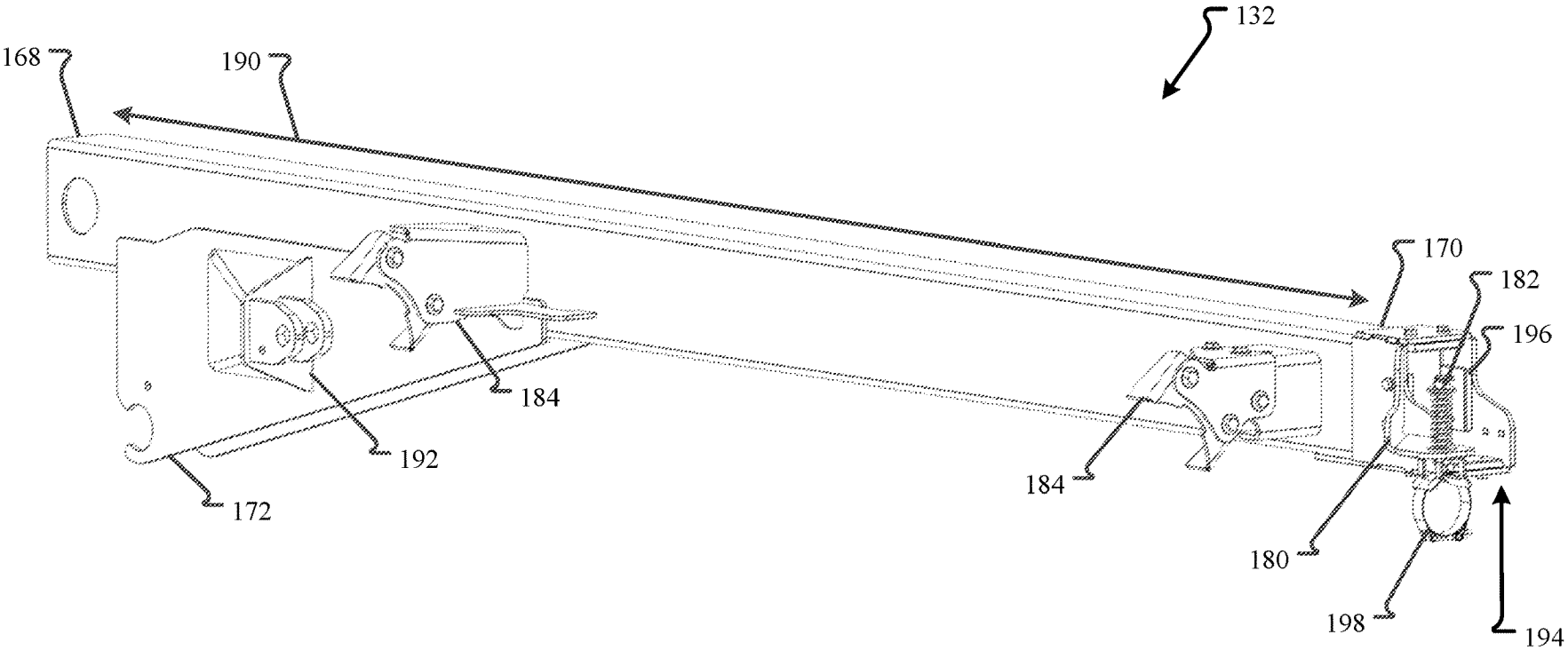
FIG. 9 is a perspective view of an exemplary first support member of the boom assembly shown in FIGS. 4-8.
Figure 10:
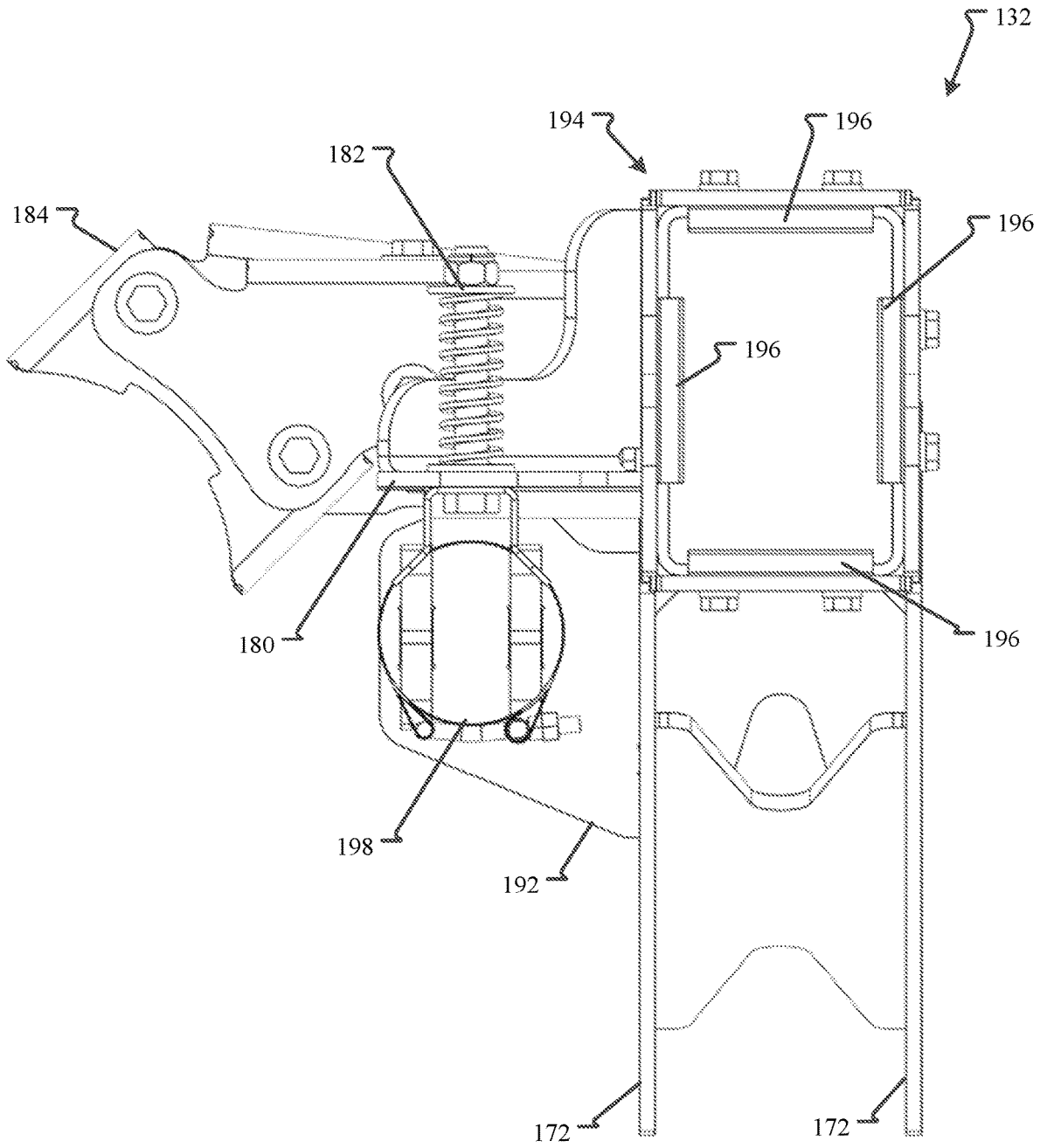
FIG. 10 is an end view of the first support member shown in FIG. 9.

FIG. 9 is a perspective view of the first support member 132 of the boom assembly 126 (shown in FIGS. 4-8). FIG. 10 is an end view of the first support member 132. Referring concurrently to FIGS. 9 and 10, certain components are described above, and thus, are not necessarily described further. The first and second ends 168, 170 of the first support member 132 define a length 190 along the longitudinal axis 150 (shown in FIG. 6) of the boom assembly 126. The first end 168 is pivotably coupled to the bracket 130 (shown in FIG. 6) so that it can pivot relative thereto, however, the first support member 132 does not extend or retract relative to the bracket 130. A fixed support 192 is coupled to one of the mounting plates 172 to support the actuator 152 (shown in FIG. 8) on one side of the first support member 132.

An end cap assembly 194 is coupled to the second end 170 of the first support member 132. The end cap assembly 194 includes a plurality of plates coupled (e.g., welded) to the first support member 132 and extending therefrom. Each plate has a guide block 196 removably coupled (e.g., via bolts) to its interior. The guide blocks 196 are thicker than the thickness of the first support member 132 and are used to position and guide the second support member 134 (shown in FIGS. 11 and 12) within the first support member 132 and enable sliding movement of the second support member 134. Additionally, the guide blocks 196 act as a low friction bearing surface. In an aspect, the inner surfaces of the guide blocks 196 correspond in shape and size to the outer perimeter surface of the second support member 134. The guide blocks 196 can be configured to reduce frictional resistance of the sliding second support member 134. In an aspect, the guide blocks 196 can be formed from a material that includes both polyethylene and brass. The polyethylene reduces friction and the brass increases bearing strength. In some examples, the ratio of polyethylene and brass can vary in the guide blocks 196 as required or desired. Other materials are also contemplated herein.

One of the plates of the end cap assembly 194 includes the support arm 180 extending therefrom. The support arm 180 supports a ring 198 that is configured to support a portion of the actuator 152. In an aspect, the spring dampener 182 is coupled to the ring 198. In the example, the first support member 132 has a hollow substantially rectangular cross-section. This cross-sectional profile enables the other support members to telescope from the inside of the first support member 132 as described herein. Additionally, the cross-sectional profile provides strength to the first support member 132 to support the vacuum hose 110 (shown in FIGS. 4 and 5). It should be appreciated that other cross-sectional member profiles can also provide these benefits and are contemplated herein, for example, hollow square or circular cross-section profiles.

Figure 11:
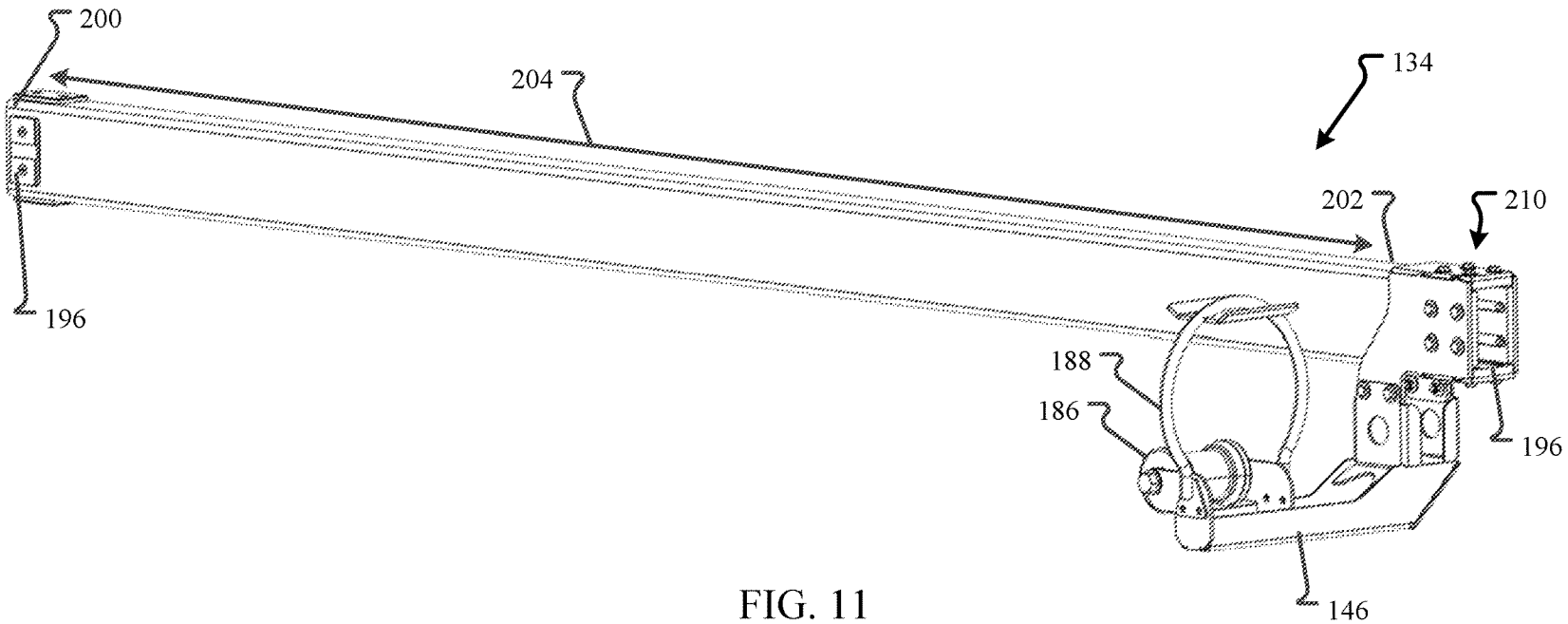
FIG. 11 is a perspective view of an exemplary second support member of the boom assembly shown in FIGS. 4-8.
Figure 12:
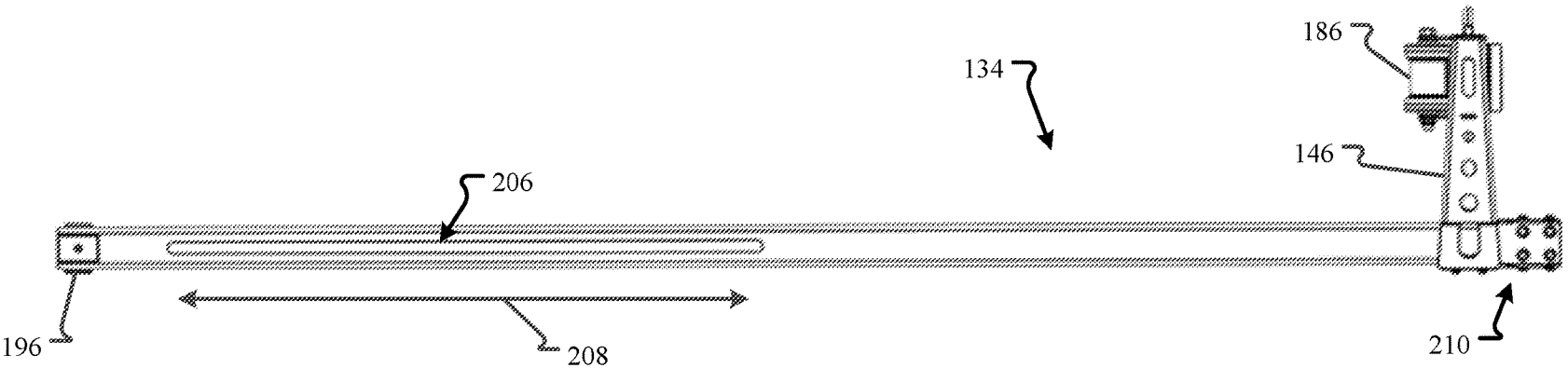
FIG. 12 is bottom view of the second support member shown in FIG. 11.
Figure 13:
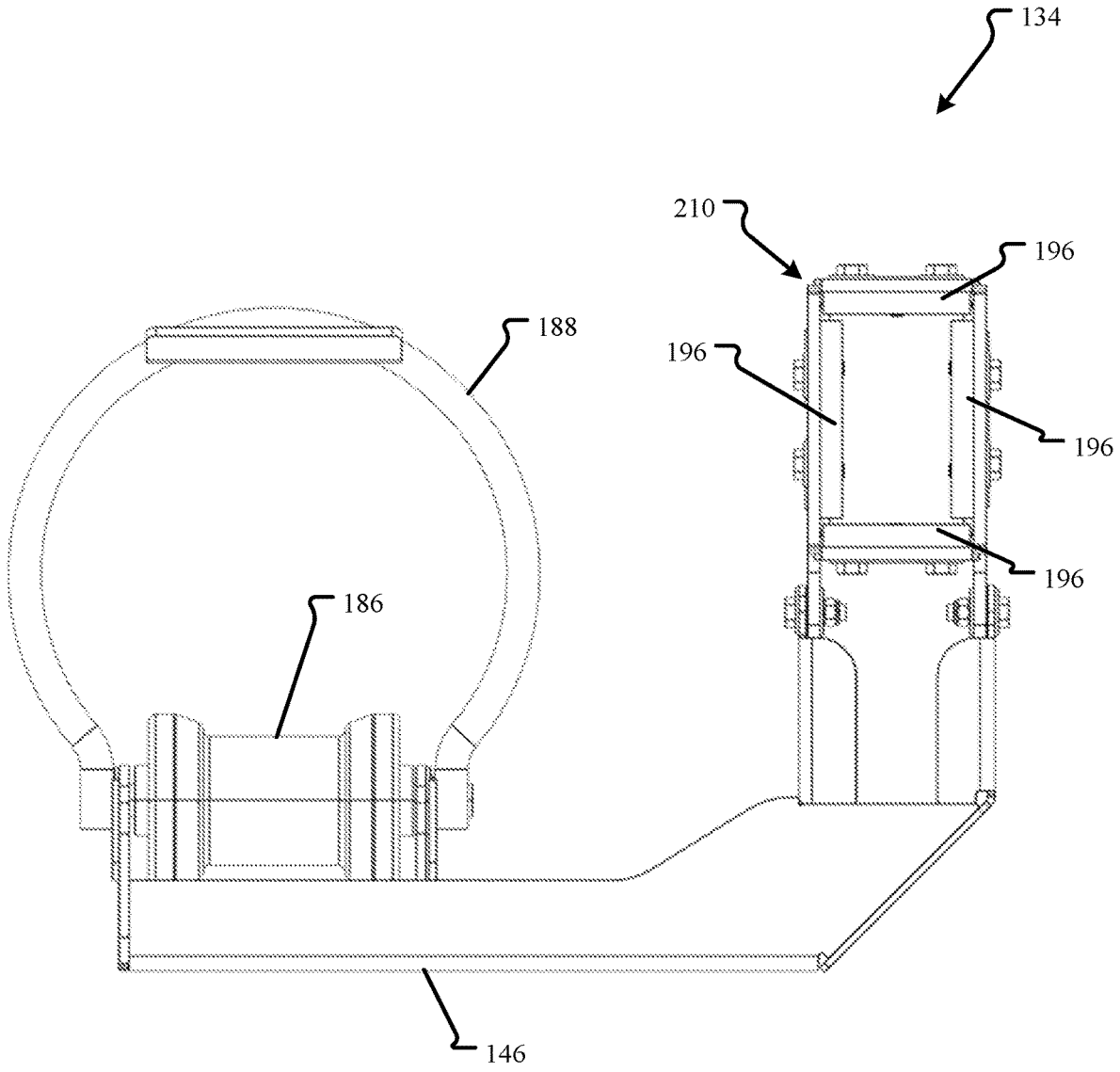
FIG. 13 is an end view of the second support member shown in FIG. 11.

FIG. 11 is a perspective view of the second support member 134 of the boom assembly 126 (shown in FIGS. 4-8). FIG. 12 is bottom view of the second support member 134. FIG. 13 is an end view of the second support member 134. Referring concurrently to FIGS. 11-13, certain components are described above, and thus, are not necessarily described further. The second support member 134 has a first end 200 and an opposite second end 202 that define a length 204 along the longitudinal axis 150 (shown in FIG. 6) of the boom assembly 126. In an aspect, the length 204 of the second support member 134 is greater than or equal to the length 190 of the first support member 132 (shown in FIG. 9). The second support member 134 has a hollow substantially rectangular cross-section that is sliding received at least partially within the first support member 132. As such, the second support member 134 has a smaller size, but similar shape, profile when compared to the first support member 132. The second end 202 of the second support member 134 extends from the second end 170 of the first support member 132 when assembled in the boom assembly 126.

The first end 200 of the second support member 134 has one or more guide blocks 196 removably coupled to (e.g., via bolts) the exterior of the member. The guide blocks 196 are used to position and guide the first end 200 of the second support member 134 within the first support member 132 and enable sliding movement of the second support member 134. In an aspect, the outer surfaces of the guide blocks 196 correspond in shape and size to the inner perimeter surface of the first support member 132. The guide blocks 196 can be configured to reduce frictional resistance of the sliding second support member 134.

An elongated track 206 is defined within the second support member 134 and proximate the first end 200. The elongated track 206 has a length 208 that is less than the length 204 of the second support member 134. A portion of the third support member 136 (shown in FIG. 14) slidingly engages with the elongated track 206 and this engagement at least partially drives the extension and reaction of the second support member 134 relative to the first support member 132 since the actuator 152 (shown in FIG. 8) is not directly coupled to the second support member 134. As such, the length 208 of the elongated track 206 at least partially defines the extended length of the third support member 136 relative to the second support member 134 and the relative movement therebetween. In an aspect, in both the extended configuration (shown in FIG. 5) and the retracted configuration (shown in FIG. 6) of the boom assembly 126, the elongated track 206 is disposed within the first support member 132.

An end cap assembly 210 is coupled to the second end 202 of the second support member 134. The end cap assembly 210 includes a plurality of plates coupled (e.g., welded) to the second support member 134 and extending therefrom. Each plate has a guide block 196 removably coupled (e.g., via bolts) to its interior. The guide blocks 196 are thicker than the thickness of the second support member 134 and are used to position and guide the third support member 136 within the second support member 134 and enable sliding movement of the third support member 136. In an aspect, the inner surfaces of the guide blocks 196 correspond in shape and size to the outer perimeter surface of the third support member 136. The guide blocks 196 can be configured to reduce frictional resistance of the sliding third support member 136.

The hose support 146 is coupled to the end cap assembly 210 is used to support the hose 110 (shown in FIGS. 4 and 5). Because the second support member 134 is disposed between the first support member 132 and the third support member 136, the hose support 146 provides an intermediary support location of the hose 110 to reduce or prevent debris accumulation and plugging.

Figure 14:
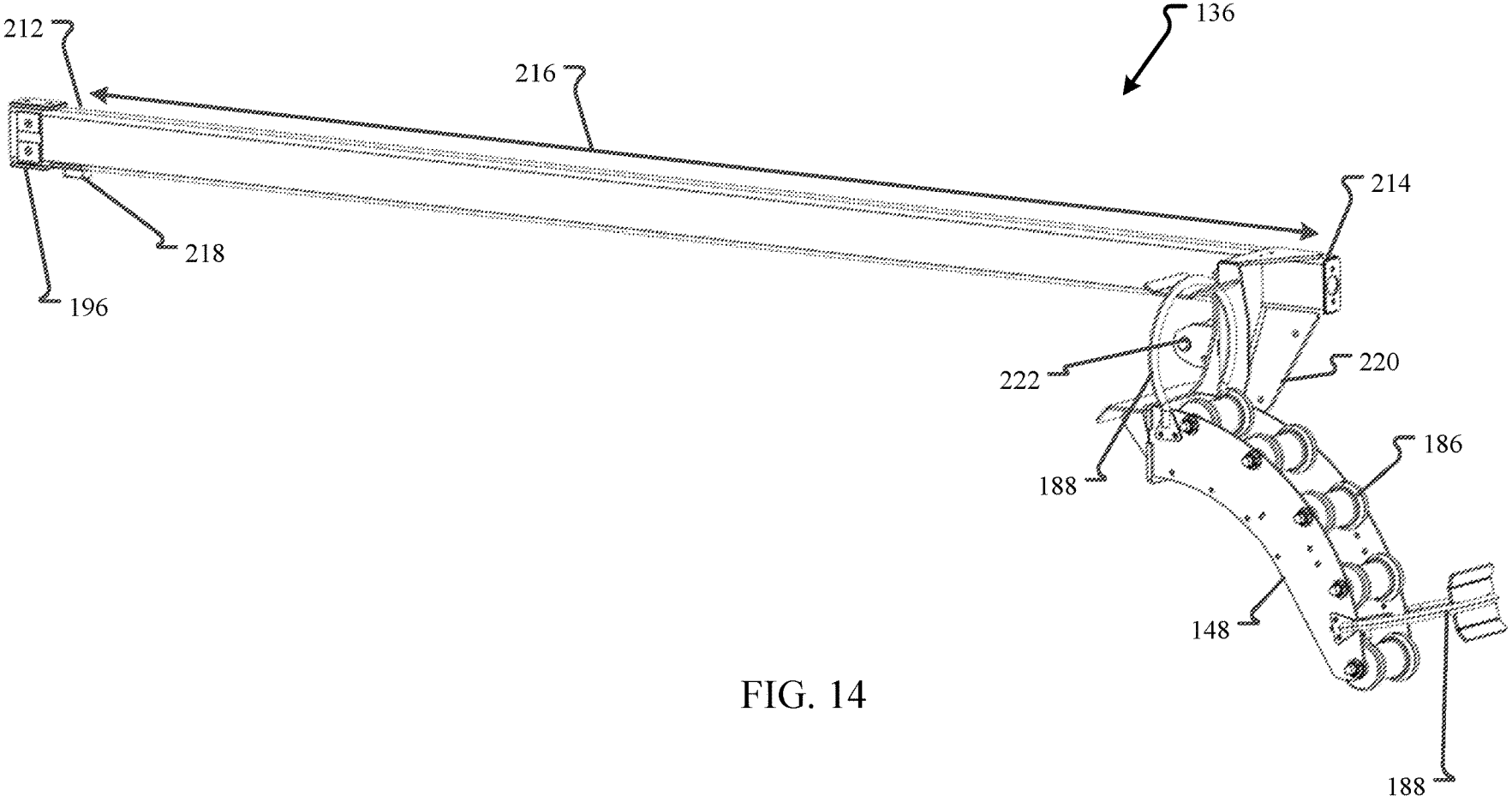
FIG. 14 is a perspective view of an exemplary third support member of the boom assembly shown in FIGS. 4-8.

FIG. 14 is a perspective view of the third support member 136 of the boom assembly 126 (shown in FIGS. 4-8). Certain components are described above, and thus, are not necessarily described further. The third support member 136 has a first end 212 and an opposite second end 214 that define a length 216 along the longitudinal axis 150 (shown in FIG. 6) of the boom assembly 126. In an aspect, the length 216 of the third support member 136 is greater than or equal to the length 190 of the first support member 132 (shown in FIG. 9). Additionally, the length 216 of the third support member 136 is greater than or equal to the length 204 of the second support member 134 (shown in FIG. 11). The third support member 136 has a hollow substantially rectangular cross-section that is sliding received at least partially within the second support member 134. As such, the third support member 136 has a smaller size, but similar shape, profile when compared to the second support member 134. The second end 214 of the third support member 136 extends from the second end 202 of the second support member 134 when assembled in the boom assembly 126.

The first end 212 of the third support member 136 has one or more guide blocks 196 removably coupled to (e.g., via bolts) the exterior of the member. The guide blocks 196 are used to position the first end 212 of the third support member 136 within the second support member 134 and enable sliding movement of the third support member 136. In an aspect, the outer surfaces of the guide blocks 196 correspond in shape and size to the inner perimeter surface of the second support member 134. The guide blocks 196 can be configured to reduce frictional resistance of the sliding third support member 136.

A pin 218 is coupled to the third support member 136 proximate the first end 212. The pin 218 is slidably received at least partially within the elongated track 206 of the second support member 134 (shown in FIG. 12). By slidingly engaging the third support member 136 with the second support member 134, movement of the second support member 134 is enabled without being coupled directly to the actuator 152 (shown in FIG. 8). For example, as the third support member 136 extends, the pin 218 slides to the distal end of the track 206 so as to extend the second support member 134, and as the third support member 136 retracts, the pin 218 slides to the proximal end of the track 206 so as to retract the second support member 134. In the example, the first end 212 of the third support member 136 is disposed within the first support member 132 in both the extended configuration (shown in FIG. 5) and the retracted configuration (shown in FIG. 4) of the boom assembly 126.

A mount 220 is used to couple the shoe 148 to the second end 214 of the third support member 136. The mount 220 can be welded to the third support member 136 and provides a fixed support 222 for the second end 178 of the actuator 152. The shoe 148 is used to support the hose 110 (shown in FIGS. 4 and 5) as described herein.

Figure 15:
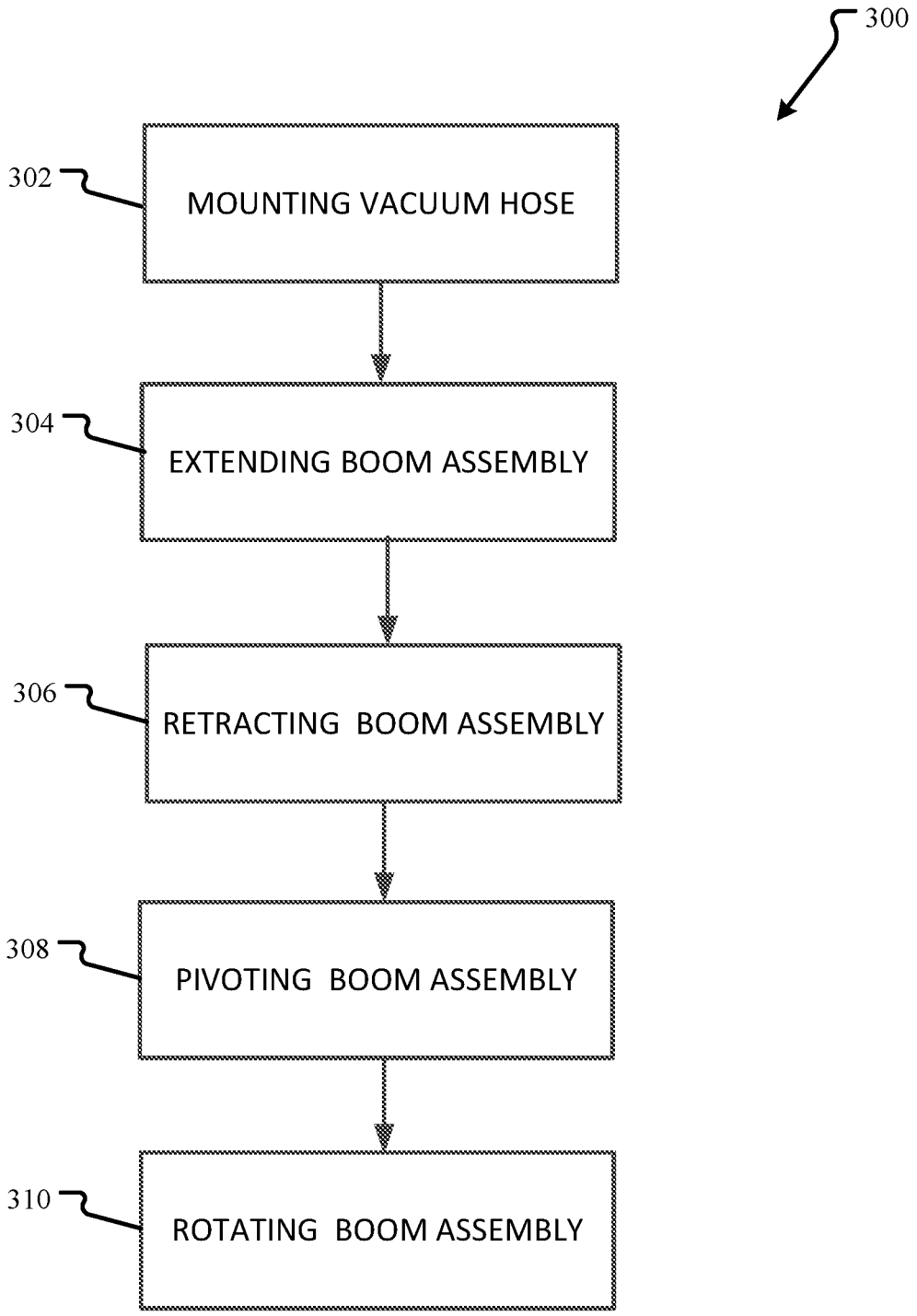
FIG. 15 is a flowchart illustrating an exemplary method of supporting a vacuum hose.

FIG. 15 is a flowchart illustrating an exemplary method 300 of supporting a vacuum hose on a boom assembly. In an aspect, the method 300 can be performed by the boom assembly and excavation vehicle as described above. The method 300 begins with mounting the vacuum hose side-by-side with three or more telescoping support members of the boom assembly (operation 302). The telescoping support members define a longitudinal axis of the boom assembly and at least a portion of the vacuum hose is disposed substantially parallel to the longitudinal axis. This reduces or prevents sagging of the vacuum hose and debris accumulation and plugging during use.

Once the vacuum hose is mounted, the boom assembly can be extended along the longitudinal axis (operation 304). An actuator is coupled between the outermost and innermost members of the three or more telescoping support members, and the extending movement of the innermost member relative to the outermost member drives movement of one or more middle members of the three or more telescoping support members. Each of the three or more telescoping support members support the vacuum hose. In an aspect, the actuator is a single hydraulic cylinder. As described herein, the outermost member is the support member that is mounted to the boom turret and the innermost member is the support member that supports the shoe. In another aspect, the innermost member is slidingly engaged with a middle member such that extending movement of the middle member is indirectly driven by the actuator.

In some examples, the method 300 further includes retracting the boom assembly along the longitudinal axis (operation 306). In an aspect, retracting movement of the innermost member relative to the outermost member drives movement of the middle member. The middle member can include a roller support so that the middle member can roll relative to the vacuum hose when extending or retracting. The innermost member can include a shoe with one or more rollers so that the innermost member can also roll relative to the vacuum hose when extending or retracting.

In another example, the method 300 can further include pivoting the boom assembly (operation 308). The vacuum hose can raise or lower with the boom assembly and maintain its side-by-side orientation during the pivoting movement. In an aspect, the pivoting movement is with respect to the debris body and the excavation vehicle, and it is the outermost member is the pivoting component. The method 300 can further include rotating the boom assembly (operation 310). The vacuum hose can maintain its side-by-side orientation during the rotating movement. In an aspect, the rotating movement is with respect to the debris body and the excavation vehicle and is driven by the turret.

It is to be understood that this disclosure is not limited to the particular structures, process steps, or materials disclosed herein, but is extended to equivalents thereof as would be recognized by those ordinarily skilled in the relevant arts. It should also be understood that terminology employed herein is used for the purpose of describing particular examples only and is not intended to be limiting. It must be noted that, as used in this specification, the singular forms "a," "an," and "the" include plural referents unless the context clearly dictates otherwise.

It will be clear that the systems and methods described herein are well adapted to attain the ends and advantages mentioned as well as those inherent therein. Those skilled in the art will recognize that the methods and systems within this specification may be implemented in many manners and as such is not to be limited by the foregoing exemplified examples and examples. In this regard, any number of the features of the different examples described herein may be combined into one single example and alternate examples having fewer than or more than all of the features herein described are possible.

While various examples have been described for purposes of this disclosure, various changes and modifications may be made which are well within the scope contemplated by the present disclosure. Numerous other changes may be made which will readily suggest themselves to those skilled in the art and which are encompassed in the spirit of the disclosure.

What is claimed is:

1. A boom assembly for an excavation vehicle comprising:

a bracket configured to couple to a turret that is rotatably mounted to a debris body of the excavation vehicle;

three or more telescoping support members, wherein a first support member of the three or more telescoping support members includes a first end that is pivotably coupled to the bracket and an opposite second end, wherein a second support member of the three or more telescoping support members includes a first end and an opposite second end, and wherein a third support member of the three or more telescoping support members is disposed at least partially between the second end of the first support member and the first end of the second support member, and wherein an elongated track is defined within the third support member and the first end of the second support member is slidingly engaged with the elongated track;

a shoe fixed to the second end of the second support member; and a single actuator, wherein one end of the actuator is coupled to the first support member at a fixed support proximate the first end of the first support member and the other end of the actuator is coupled to the second support member at a fixed support proximate the second end of the second support member, the actuator bypassing the third support member, and wherein the actuator is configured to extend and retract the second support member relative to the first support member and at least partially indirectly drive movement of the third support member.

2. The boom assembly of claim 1, wherein a length of the elongated track at least partially defines an extended length of the second support member relative to the third support member.

3. The boom assembly of claim 1, further comprising a vacuum hose supported by each of the three or more telescoping support members.

4. The boom assembly of claim 3, wherein the vacuum hose is side-by-side with the three or more telescoping support members.

5. The boom assembly of claim 4, wherein the actuator is disposed at least partially between the vacuum hose and the three or more telescoping support members.

6. The boom assembly of claim 3, wherein the shoe at the second end of the second support member comprises a roller support for the vacuum hose.

7. The boom assembly of claim 1, wherein the actuator comprises a single hydraulic cylinder actuator.

8. The boom assembly of claim 1, wherein the three or more telescoping support members have a collapsed length of about 15 feet and an extended length of about 22 feet.

9. The boom assembly of claim 1, wherein the three or more telescoping support members have an extension length of greater than or equal to 7 feet.

10. The boom assembly of claim 1, wherein each of the three or more telescoping support members have a substantially rectangular cross-section.

11. An excavation vehicle comprising:

a debris body;

a vacuum hose;

a turret rotatably coupled to a top of the debris body and coupling the debris body and the vacuum hose in flow communication; and a boom assembly coupled to the turret and configured to at least partially support the vacuum hose, wherein the boom assembly comprises:

a shoe configured to support at least a portion of the vacuum hose;

a bracket that mounts to the turret;

a first support member having a first end pivotably coupled to the bracket and an opposite second end;

a second support member slidingly supported at least partially within the first support member;

a third support member slidingly supported at least partially within the second support member, wherein the third support member includes a first end and an opposite second end, the shoe is fixedly coupled to the second end of the third support member with the second support member disposed at least partially between the second end of the first support member and the first end of the third support member; and a single hydraulic cylinder configured to extend and retract the shoe relative to the turret, wherein the hydraulic cylinder is supported on the first support member at a fixed position proximate the first end of the first support member and the third support member at a fixed position proximate the second end of the third support member, the hydraulic cylinder bypassing the second support member and configured to extend and retract the third support member relative to the first support member and at least partially indirectly drive movement of the second support member.

12. The excavation vehicle of claim 11, wherein the second support member has a first end and a second end, wherein the second end of the third support member extends out from the second end of the second support member, and wherein an elongated track is defined proximate the first end of the second support member and a pin is coupled to the third support member proximate the first end, the pin being slidably received at least partially within the elongated track.

13. The excavation vehicle of claim 12, wherein the elongated track at least partially defines relative movement between the third support member and the second support member.

14. The excavation vehicle of claim 12, wherein the boom assembly is configured to move between an extended configuration and a retracted configuration, and wherein in both the extended configuration and the retracted configuration, the elongated track of the second support member is disposed within the first support member.

15. The excavation vehicle of claim 14, wherein the first end of the third support member is disposed within the first support member in the extended configuration of the boom assembly.

16. The excavation vehicle of claim 12, wherein the second end of the second support member comprises a roller support for the vacuum hose.

17. The excavation vehicle of claim 11, wherein the hydraulic cylinder is a single stage hydraulic cylinder, and the hydraulic cylinder is disposed at least partially between the support members and the vacuum hose.

18. The excavation vehicle of claim 11, further comprising a second hydraulic cylinder coupled between the first support member and the bracket, wherein the second hydraulic cylinder is configured to raise and lower the shoe relative to the turret.

19. The excavation vehicle of claim 11, wherein the vacuum hose is side-by-side with the boom assembly on top of the debris body.

20. The excavation vehicle of claim 11, wherein the vacuum hose comprises at least one substantially rigid section and at least one substantially flexible section.

21. A method of supporting a vacuum hose on a boom assembly, the method comprising:

mounting the vacuum hose side-by-side with three or more telescoping support members of the boom assembly, wherein the three or more telescoping support members define a longitudinal axis of the boom assembly and at least a portion of the vacuum hose is disposed substantially parallel to the longitudinal axis, and wherein the three or more telescoping support members include an outermost member having a first end and an opposite second end, an innermost member having a first end and an opposite second end, and one or more middle members disposed at least partially between the second end of the outermost member and the first end of the innermost member, the second end of the innermost member fixedly supporting a shoe for supporting the vacuum hose; and extending the boom assembly along the longitudinal axis, wherein a single actuator is coupled between the first end of the outermost member at a fixed support and the second end of the innermost member at a fixed support, wherein the single actuator bypasses the one or more middle members such that extending movement of the innermost member relative to the outermost member at least partially indirectly drives movement of the one or more middle members, and wherein each of the three or more telescoping support members support the vacuum hose.

22. The method of claim 21, further comprising retracting the boom assembly along the longitudinal axis, wherein retracting movement of the innermost member relative to the outermost member drives movement of the one or more middle members.

23. The method of claim 21, wherein the one or more middle members includes a roller support and the step of extending the boom assembly includes rolling the one or more middle members relative to the vacuum hose.

24. The method of claim 21, further comprising pivoting the boom assembly, wherein the vacuum hose raises or lowers with the boom assembly and maintains the side-by-side orientation during pivoting.

25. The method of claim 21, further comprising rotating the boom assembly, wherein the vacuum hose maintains the side-by side orientation during rotation.

* * * * *